US005984090A

United States Patent [19]

Banfield

[11] Patent Number: 5,984,090

[45] Date of Patent: Nov. 16, 1999

[54] GUITAR CLEANING KIT

[76] Inventor: Roger E. Banfield, 3209 Monida Ct., Lexington, Ky. 40515

[21] Appl. No.: 09/234,693

[22] Filed: Jan. 21, 1999

[51] Int. Cl.[6] ..... B65D 69/00

[52] U.S. Cl. ..... 206/223; 206/314; 206/362; 15/160; 15/257.01

[58] Field of Search ..... 206/223, 579, 206/314, 14, 234, 361, 362, 362.1, 362.2, 262.3, 561; 15/184, 186, 160, 257.01, 257.05

[56] References Cited

U.S. PATENT DOCUMENTS 286,399 10/1883 Distin ..... 206/314
4,024,880 5/1977 Newton et al. ..... 206/223
4,175,659 11/1979 Horian et al. ..... 206/362
4,694,525 9/1987 Yamamoto et al. ..... 15/160
4,884,689 12/1989 Su-Chin ..... 206/561
5,862,812 1/1999 Dumler ..... 15/160

*Primary Examiner*—B. Dayoan
*Assistant Examiner*—Luan K. Bui

[57] ABSTRACT

A guitar cleaning kit for cleaning a guitar. The guitar cleaning kit includes a box with an open top and a spaced apart pair of divider panels forming a plurality of compartments in the box. A tray is provided in the box and rested on the divider panels. The tray has a plurality of elongate slots therethrough. A plurality of brushes are provided each having a head portion and a handle portion. The head portion of each brush has a plurality of outwardly extending bristles.

7 Claims, 3 Drawing Sheets

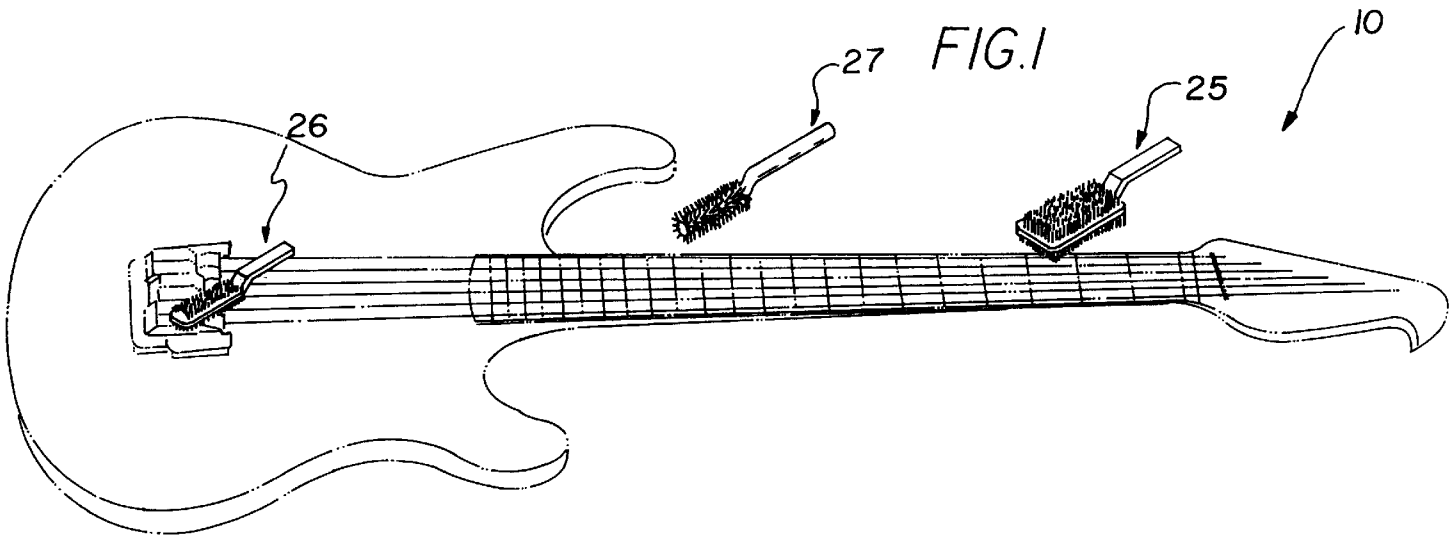
FIG.1
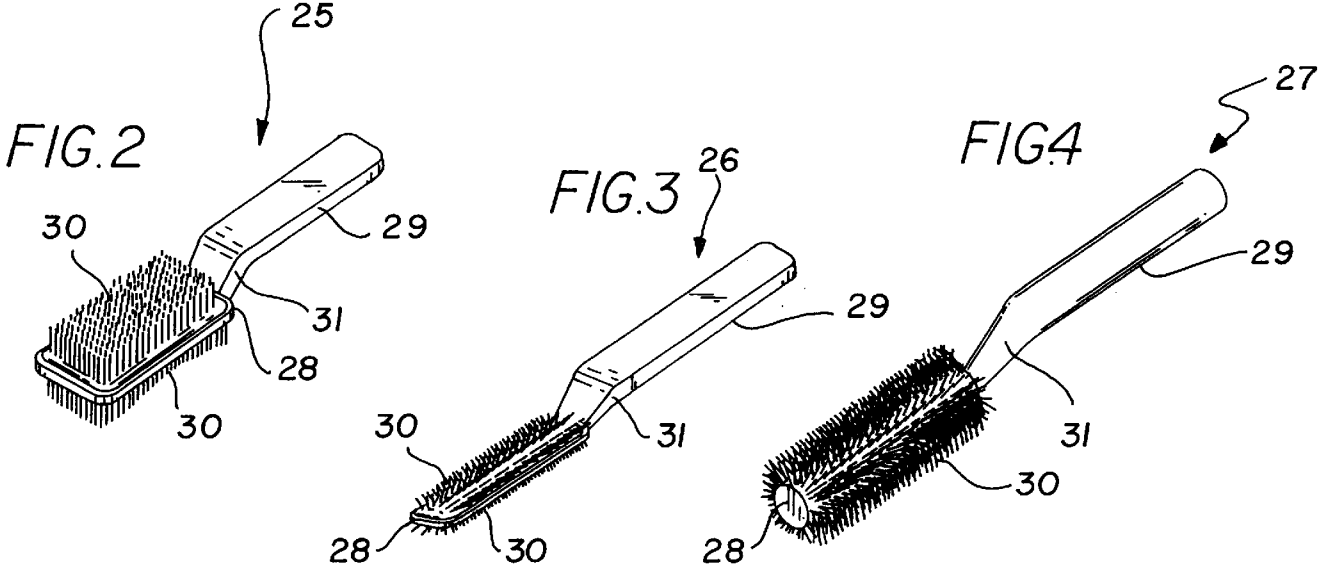
FIG.2
FIG.3
FIG.4

GUITAR CLEANING KIT

BACKGROUND OF THE INVENTION

1. Field of the Invention

The present invention relates to guitar cleaning kits and more particularly pertains to a new guitar cleaning kit for cleaning a guitar.

2. Description of the Prior Art

The use of guitar cleaning kits is known in the prior art. More specifically, guitar cleaning kits heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,112,808 by Ketterer; U.S. Pat. No. 5,337,505 by Brown et al.; U.S. Pat. No. 4,967,439 by LaLonde; U.S. Pat. No. 4,539,228 by Lazarus; U.S. Pat. No. 5,111,934 by Morin; and U.S. Pat. No. Des. 338,296 by Yarborough.

While these devices fulfill their respective, particular objectives and requirements, the aforementioned patents do not disclose a new guitar cleaning kit. The inventive device includes a box with an open top and a spaced apart pair of divider panels forming a plurality of compartments in the box. A tray is provided in the box and rested on the divider panels. The tray has a plurality of elongate slots therethrough. A plurality of brushes are provided each having a head portion and a handle portion. The head portion of each brush has a plurality of outwardly extending bristles.

In these respects, the guitar cleaning kit according to the present invention substantially departs from the conventional concepts and designs of the prior art, and in so doing provides an apparatus primarily developed for the purpose of cleaning a guitar.

SUMMARY OF THE INVENTION

In view of the foregoing disadvantages inherent in the known types of guitar cleaning kits now present in the prior art, the present invention provides a new guitar cleaning kit construction wherein the same can be utilized for cleaning a guitar.

The general purpose of the present invention, which will be described subsequently in greater detail, is to provide a new guitar cleaning kit apparatus and method which has many of the advantages of the guitar cleaning kits mentioned heretofore and many novel features that result in a new guitar cleaning kit which is not anticipated, rendered obvious, suggested, or even implied by any of the prior art guitar cleaning kits, either alone or in any combination thereof.

To attain this, the present invention generally comprises a box with an open top and a spaced apart pair of divider panels forming a plurality of compartments in the box. A tray is provided in the box and rested on the divider panels. The tray has a plurality of elongate slots therethrough. A plurality of brushes are provided each having a head portion and a handle portion. The head portion of each brush has a plurality of outwardly extending bristles.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new guitar cleaning kit apparatus and method which has many of the advantages of the guitar cleaning kits mentioned heretofore and many novel features that result in a new guitar cleaning kit which is not anticipated, rendered obvious, suggested, or even implied by any of the prior art guitar cleaning kits, either alone or in any combination thereof.

It is another object of the present invention to provide a new guitar cleaning kit which may be easily and efficiently manufactured and marketed.

It is a further object of the present invention to provide a new guitar cleaning kit which is of a durable and reliable construction.

An even further object of the present invention is to provide a new guitar cleaning kit which is susceptible of a low cost of manufacture with regard to both materials and labor, and which accordingly is then susceptible of low prices of sale to the consuming public, thereby making such guitar cleaning kit economically available to the buying public.

Still yet another object of the present invention is to provide a new guitar cleaning kit which provides in the apparatuses and methods of the prior art some of the advantages thereof, while simultaneously overcoming some of the disadvantages normally associated therewith.

Still another object of the present invention is to provide a new guitar cleaning kit for cleaning a guitar.

Yet another object of the present invention is to provide a new guitar cleaning kit which includes a box with an open top and a spaced apart pair of divider panels forming a plurality of compartments in the box. A tray is provided in the box and rested on the divider panels. The tray has a plurality of elongate slots therethrough. A plurality of brushes are provided each having a head portion and a handle portion. The head portion of each brush has a plurality of outwardly extending bristles.

Still yet another object of the present invention is to provide a new guitar cleaning kit that lets a user thoroughly clean a guitar including the neck of the guitar, in-between and under the guitar strings and the bridge of the guitar.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new guitar cleaning kit in use cleaning a guitar according to the present invention.

FIG. 2 is a schematic perspective view of a first brush of the present invention.

FIG. 3 is a schematic perspective view of a second brush of the present invention.

FIG. 4 is a schematic perspective view of a third brush of the present invention.

DESCRIPTION OF THE PREFERRED EMBODIMENT

Figure 5:
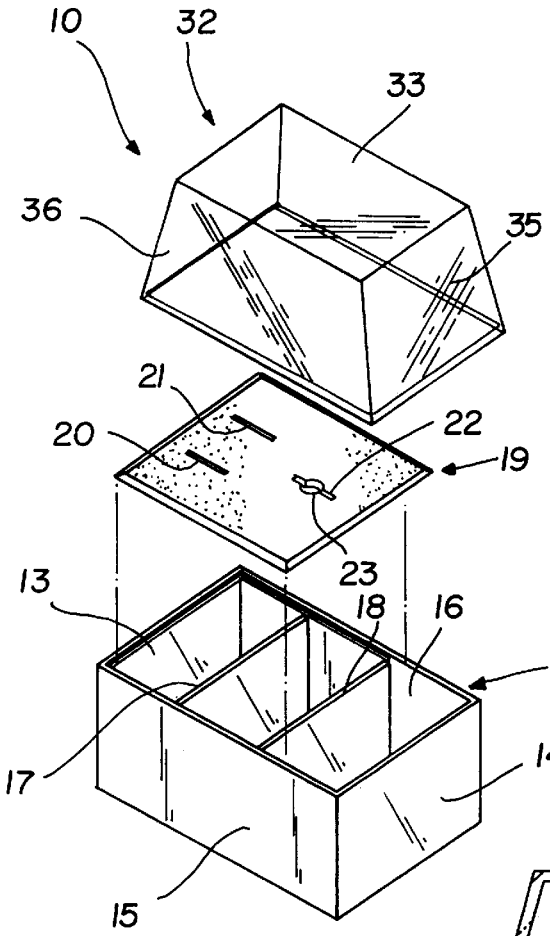
FIG. 5 is a schematic exploded perspective view of the box, tray and cover of the present invention.

With reference now to the drawings, and in particular to FIGS. 1 through 7 thereof, a new guitar cleaning kit embodying the principles and concepts of the present invention and generally designated by the reference numeral 10 will be described.

As best illustrated in FIGS. 1 through 7, the guitar cleaning kit 10 generally comprises a box with an open top and a spaced apart pair of divider panels forming a plurality of compartments in the box. A tray is provided in the box and rested on the divider panels. The tray has a plurality of elongate slots therethrough. A plurality of brushes are provided each having a head portion and a handle portion. The head portion of each brush has a plurality of outwardly extending bristles.

In closer detail, the guitar cleaning kit 10 comprises a generally rectangular box 11 having a generally rectangular upper edge defining an open top. The box has bottom wall 12, a pair of end walls 13, 14, and a pair of side walls 15, 16. The end walls of the box preferably lie in substantially parallel planes to one another. The side walls of the box preferably lie in substantially parallel planes to one another and substantially perpendicular to the planes of the end walls of the box. The bottom wall of the box lies in a plane substantially perpendicular to the planes of the end and side walls of the box.

A spaced apart pair of generally rectangular divider panels 17, 18 are provided in the box to form a plurality of compartments in the box. The divider panels are upwardly extended from the bottom wall of the box and between the side wall of the box. The divider panels preferably lie in substantially parallel planes to one another and the planes of the end walls of the box and substantially perpendicular to the side walls and bottom wall of the box. The divider panels are spaced apart at generally equal intervals between the end walls of the box. The divider panels each have an upper edge lying in a common plane with one another. The upper edge of the box preferably lie in a plane substantially parallel to the common plane of the upper edges of the divider panels. The common plane of the divider panels is positioned between the bottom wall of the box and the upper edge of the box.

A generally rectangular tray 19 is provided in the box and rested on the upper edges of the divider panels. The tray substantially covers first and second compartments of the plurality of compartments formed by the divider panels in the box. The tray comprising a resiliently deformable material such as a resiliently deformable rubber material.

The tray has a plurality of elongate slots 20, 21, 22 therethrough. First and second slots of the plurality of slots of the tray are positioned over the first compartment. A third of the slots of the plurality of slots of the tray is positioned over the second compartment. The slots of the tray are preferably extended generally parallel to the side walls of the box. The third slot has a centrally positioned generally circular cutout 23 therein having a diameter greater than a width of the third slot defined in a direction extending between the side walls of the box.

The first compartment has a width defined between an adjacent end wall of box and an adjacent divider panel. The second compartment has a width defined between an adjacent pair of divider panels. The widths of the first and second compartments are about equal to one another. Each of the slots has a length defined in a direction extending between the end walls of the box. The lengths of the first and second slots are less than the width of the first compartment. Preferably, the lengths of the first and second slots are between about one-half and about nine-tenths of the width of the first compartment. The length of the third slot is less than the width of the second compartment. Preferably, the length of the third slot is between about one-half and about nine-tenths of the width of the second compartment.

The first and second compartments define reservoirs designed for holding a guitar fluid cleaning solvent 24 therein. A third of the compartments is designed for holding other supplies including rags and polishing cloths therein.

A plurality of brushes 25, 26, 27 are included in the kit. Each of the brushes has a head portion 28 and a handle portion 29. The head portion of each brush has a plurality of outwardly extending resilient bristles 30 each terminating at a free end. Each of the brushes has a skewed neck portion 31 connecting associated head and handle portions of the respective brush together. The neck portion of each brush is extended at obtuse angles to associated head and handle portions of the respective brush.

Figure 7:
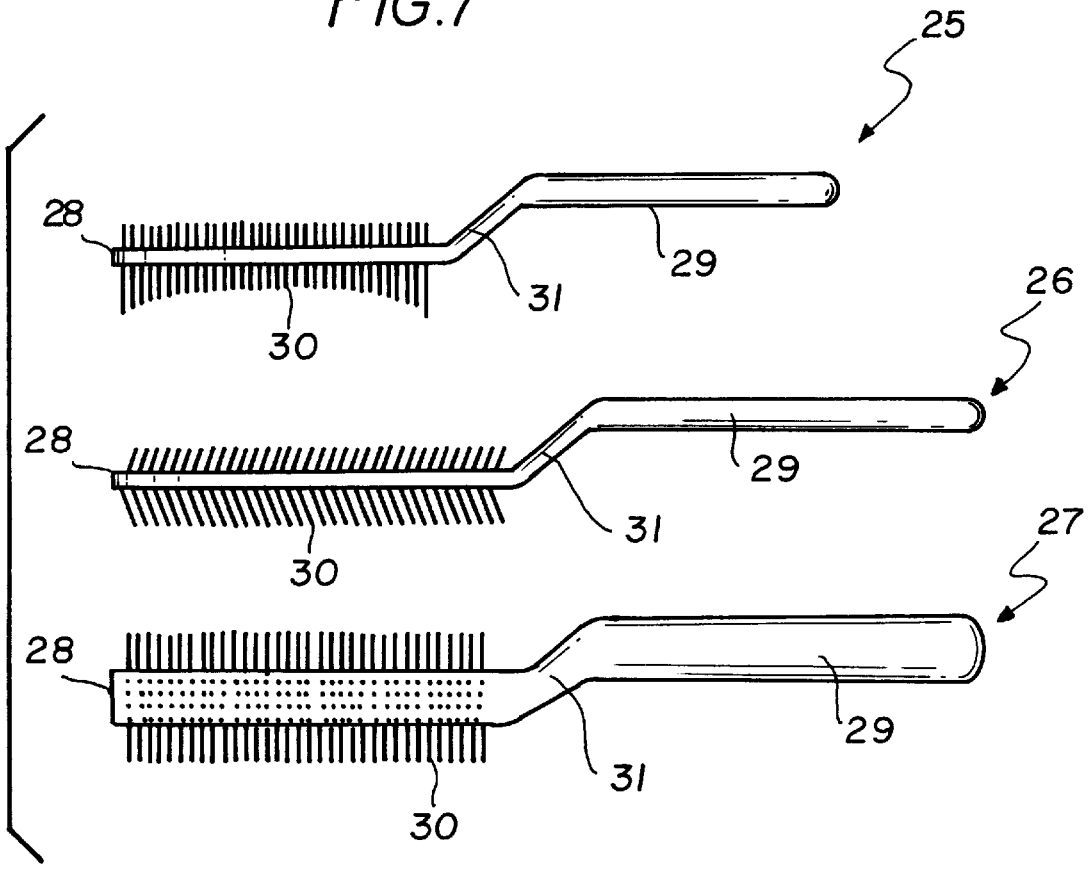
FIG. 7 is a schematic side view of the brushes of the present invention.

With reference to FIG. 2, the head portion of a first of brushes 25 is generally rectangular in shape and has a pair of opposite generally rectangular and generally planar faces. A first portion of the bristles of the first brush are outwardly extended from a first of the faces of the first brush while a remainder second portion of the bristles of the first brush are outwardly extended from a second of the faces of the first brush. As best illustrated in FIG. 7, the free ends of the first portion of bristles of the first brush generally lie in a common plane generally parallel to the first face of the head portion of the first brush and the free ends of the second portion of bristles of the first brush form a generally arcuate surface has a concavity facing away from the second face of the head portion of the first brush.

In use, the first brush is designed for cleaning the neck region of a guitar as illustrated in FIG. 1. The handle portion of the first brush ideally has a length of about 3 cm with the neck portion of the first brush ideally having a length of about 2 cm. The head portion of the first brush ideally has a length defined outwardly from the neck portion of the first brush of about 6 cm. In this ideal embodiment, the first portion of the bristles of the first brush each have a length defined between the first face of the first brush and the respective free end of about 1 cm while the second portion of the bristles of the first brush each have a length defined between the second face of the first brush and the respective free end between about 1 cm and 2 cm.

With reference to FIG. 3, the head portion of a second of brushes 26 has a pair of opposite arcuate faces each has outwardly facing convexities. The faces of the second brush preferably have substantially equal radii of curvatures. A first portion of the bristles of the second brush outwardly radiate from a first of the faces of the second brush while a remainder second portion of the bristles of the second brush outwardly radiate from a second of the faces of the first brush. The free ends of the first portion of bristles of the second brush define a convex surface has a radius of curvature generally equal to the radius of curvature of the first face of the second brush. The free ends of the second portion of bristles of the second brush define a convex surface has a radius of curvature generally equal to the radius of curvature of the second face of the second brush.

In use, the second brush is designed for cleaning the bridge region (including the pickups) and details of a guitar as illustrated in FIG. 1. Ideally, the handle portion of the second brush has a length of about 4 cm with the neck portion of the second brush has a length of about 3 cm. In this ideal embodiment, the head portion of the second brush has a length defined outwardly from the neck portion of the second brush of about 9 cm. The first and second portions of the bristles of the second brush each ideally have has a length defined between the adjacent associated face of the second brush and the respective free end of about 1 cm. Ideally, the bristles of the first brush are more rigid than the bristles of the second brush.

With reference to FIG. 4, the head portion of a third of brushes 27 is generally cylindrical in shape. the bristles of the third brush outwardly radiate from the head portion of the third brush. In use, the third brush is designed for cleaning the top strings of a guitar as illustrated in FIG. 1. The handle portion of the third brush ideally has a length of about 7 cm with the neck portion of the third brush has a length of about 5 cm. The head portion of the third brush ideally has a length defined outwardly from the neck portion of the third brush of about 10 cm. Ideally, the bristles of the third brush each have a length defined between the head portion of the third brush and the respective free end of about 1 cm.

The head portion of the first brush is removable inserted through the first slot of the tray and into the first compartment such that a portion of the head portion of the first brush is submerged in the fluid cleaning solvent in the first compartment. The head portion of the second brush is removably inserted through the second slot of the tray and into the first compartment such that a portion of the head portion of the second brush is submerged in the fluid cleaning solvent in the first compartment. The head portion of the third brush is removably inserted through the third slot of the tray and into the second compartment such that a portion of the head portion of the third brush is submerged in the fluid cleaning solvent in the second compartment. The handles of the brushes upwardly extend from the tray.

Figure 6:
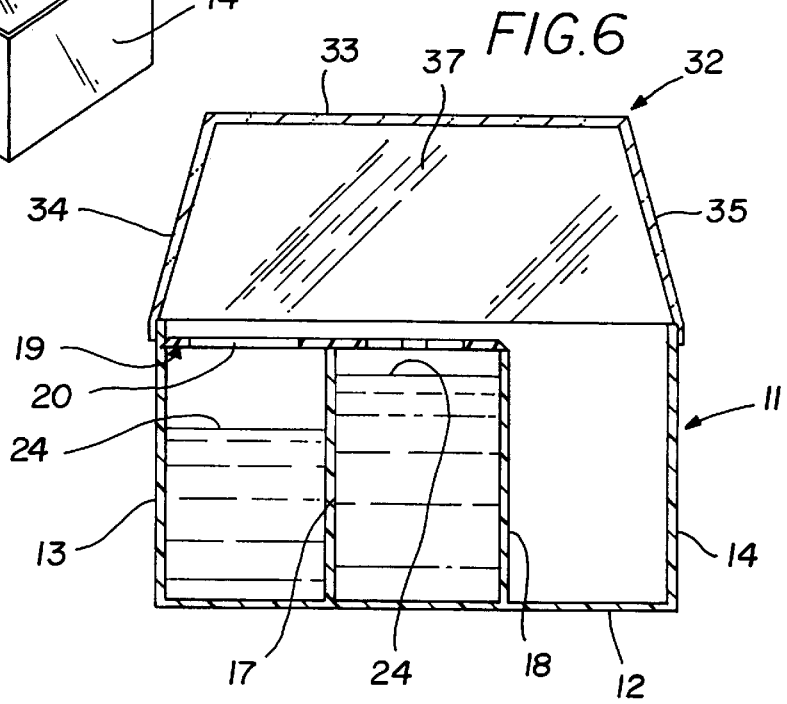
FIG. 6 is a schematic cross sectional view of the box, tray and cover of the present invention.

A generally frustum-shaped removable cover 32 substantially covering the open top of the box. The cover comprises a generally rectangular top panel 33 and a pair of end panels 34, 35 and a pair of side panels 36, 37. The end and side panels of the cover downwardly and outwardly extend from the top panel of the cover. The end and side panels of the cover terminate at a generally rectangular lower edge of the cover defining an open bottom of the cover. As best illustrated in FIG. 6, the upper edge of the box is inserted into the open bottom of the cover so that the top panel of the cover is spaced above the upper edge of the box. The handles of the brushes are extended into the open bottom of the cover. Ideally, the cover comprises a translucent or transparent material.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A guitar cleaning kit, comprising:

a box having an open top;

a spaced apart pair of divider panels being provided in said box, said divider panels forming a plurality of compartments in said box;

a tray being provided in said box and resting on said divider panels, said tray substantially covering first and second compartments of said plurality of compartments formed by said divider panels in said box;

said tray having a plurality of elongate slots therethrough, first and second slots of said plurality of slots of said tray being positioned over said first compartment, a third of said slots of said plurality of slots of said tray being positioned over said second compartment;

a plurality of brushes each having a head portion and a handle portion, said head portion of each brush having a plurality of outwardly extending bristles each terminating at a free end;

said head portion of a first of said brushes being generally rectangular in shape and having a pair of opposite generally rectangular and generally planar faces;

a first portion of said bristles of said first brush being outwardly extended from a first of said faces of said first brush, a second portion of said bristles of said first brush being outwardly extended from a second of said faces of said first brush;

said free ends of said first portion of bristles of said first brush generally lying in a common plane generally parallel to said first face of said head portion of said first brush;

said free ends of said second portion of bristles of said first brush forming a generally arcuate surface having a concavity facing away from said second face of said head portion of said first brush;

said head portion of a second of said brushes having a pair of opposite arcuate faces each having outwardly facing convexities;

a first portion of said bristles of said second brush outwardly radiating from a first of said faces of said second brush, a second portion of said bristles of said second brush outwardly radiating from a second of said faces of said first brush;

said free ends of said first portion of bristles of said second brush defining a convex surface;

said free ends of said second portion of bristles of said second brush defining a convex surface;

said head portion of a third of said brushes being generally cylindrical in shape;

said bristles of said third brush outwardly radiating said head portion of said third brush;

said head portion of said first brush being inserted through said first slot of said tray and into said first compartment;

said head portion of said second brush being inserted through said second slot of said tray and into said first compartment; and said head portion of said third brush being inserted through said third slot of said tray and into said second compartment.

2. The guitar cleaning kit of claim 1, wherein said tray comprises a resiliently deformable material.

3. The guitar cleaning kit of claim 1, wherein said third slot has a centrally positioned generally circular cutout therein.

4. The guitar cleaning kit of claim 1, wherein a fluid cleaning solvent is provided in said first and second compartments.

5. The guitar cleaning kit of claim 1, each of said brushes has a neck portion connecting associated head and handle portions of the respective brush together, said neck portion of each brush being extended at obtuse angles to associated head and handle portions of the respective brush.

6. The guitar cleaning kit of claim 1, further comprising a cover substantially covering said open top of said box.

7. A guitar cleaning kit, comprising:

a generally rectangular box having a generally rectangular upper edge defining an open top;

said box having bottom wall, a pair of end walls, and a pair of side walls;

said end walls of said box lying in substantially parallel planes to one another;

said side walls of said box lying in substantially parallel planes to one another and substantially perpendicular to said planes of said end walls of said box;

said bottom wall of said box lying in a plane substantially perpendicular to said planes of said end and side walls of said box;

a spaced apart pair of generally rectangular divider panels being provided in said box, said divider panels forming a plurality of compartments in said box;

said divider panels being upwardly extended from said bottom wall of said box and between said side wall of said box, said divider panels lying in substantially parallel planes to one another and said planes of said end walls of said box and substantially perpendicular to said side walls and bottom wall of said box;

said divider panels being spaced apart at generally equal intervals between said end walls of said box;

said divider panels each having an upper edge lying in a common plane with one another, said upper edge of said box lying in a plane substantially parallel to said common plane of said upper edges of said divider panels, said common plane of said divider panels being positioned between said bottom wall of said box and said upper edge of said box;

a generally rectangular tray being provided in said box, said tray being resting on said upper edges of said divider panels, said tray substantially covering first and second compartments of said plurality of compartments formed by said divider panels in said box;

said tray comprising a resiliently deformable material;

said tray having a plurality of elongate slots therethrough, first and second slots of said plurality of slots of said tray being positioned over said first compartment, a third of said slots of said plurality of slots of said tray being positioned over said second compartment;

said slots of said tray being extended generally parallel to said side walls of said box;

said third slot having a centrally positioned generally circular cutout therein having a diameter greater than a width of said third slot defined in a direction extending between said side walls of said box;

said first compartment having a width defined between an adjacent end wall of box and an adjacent divider panel, said second compartment having a width defined between an adjacent pair of divider panels, said widths of said first and second compartments being about equal to one another;

each of said slots having a length defined in a direction extending between said end walls of said box;

said lengths of said first and second slots being less than said width of said first compartment, said lengths of said first and second slots being between about one-half and about nine-tenths of said width of said first compartment;

said length of said third slot being less than said width of said second compartment, said length of said third slot being between about one-half and about nine-tenths of said width of said second compartment;

a fluid cleaning solvent being provided in said first and second compartments;

a plurality of brushes each having a head portion and a handle portion, said head portion of each brush having a plurality of outwardly extending bristles each terminating at a free end;

each of said brushes having a neck portion connecting associated head and handle portions of the respective brush together, said neck portion of each brush being extended at obtuse angles to associated head and handle portions of the respective brush;

said head portion of a first of said brushes being generally rectangular in shape and having a pair of opposite generally rectangular and generally planar faces;

a first portion of said bristles of said first brush being outwardly extended from a first of said faces of said first brush, a second portion of said bristles of said first brush being outwardly extended from a second of said faces of said first brush;

said free ends of said first portion of bristles of said first brush generally lying in a common plane generally parallel to said first face of said head portion of said first brush;

said free ends of said second portion of bristles of said first brush forming a generally arcuate surface having a concavity facing away from said second face of said head portion of said first brush;

said head portion of a second of said brushes having a pair of opposite arcuate faces each having outwardly facing convexities;

said faces of said second brush having substantially equal radii of curvatures;

a first portion of said bristles of said second brush outwardly radiating from a first of said faces of said second brush, a second portion of said bristles of said second brush outwardly radiating from a second of said faces of said first brush;

said free ends of said first portion of bristles of said second brush defining a convex surface having a radius of curvature generally equal to said radius of curvature of said first face of said second brush;

said free ends of said second portion of bristles of said second brush defining a convex surface having a radius of curvature generally equal to said radius of curvature of said second face of said second brush;

said head portion of a third of said brushes being generally cylindrical in shape;

said bristles of said third brush outwardly radiating said head portion of said third brush;

said head portion of said first brush being inserted through said first slot of said tray and into said first compartment such that a portion of said head portion of said first brush is submerged in said fluid cleaning solvent in said first compartment;

said head portion of said second brush being inserted through said second slot of said tray and into said first compartment such that a portion of said head portion of said second brush is submerged in said fluid cleaning solvent in said first compartment;

said head portion of said third brush being inserted through said third slot of said tray and into said second compartment such that a portion of said head portion of said third brush is submerged in said fluid cleaning solvent in said second compartment;

said handles of said brushes upwardly extending from said tray;

a generally frustum-shaped cover substantially covering said open top of said box, said cover comprising a generally rectangular top panel and a pair of end panels and a pair of side panels, said end and side panels of said cover downwardly and outwardly extending from said top panel of said cover;

said end and side panels of said cover terminating at a generally rectangular lower edge of said cover defining an open bottom of said cover, said upper edge of said box being inserted into said open bottom of said cover, said top panel of said cover being spaced above said upper edge of said box;

said handles of said brushes being extended into said open bottom of said cover; and wherein said cover comprises a translucent material.

* * * * *